United States Patent [19]

Chappot

[11] 4,375,856

[45] Mar. 8, 1983

[54] APPARATUS FOR INSERTING AND EXTRACTING FLEXIBLE FLAT OBJECTS INTO AND OUT FROM A MAGAZINE

[75] Inventor: Alain Chappot, Corbeil Essonnes, France

[73] Assignee: Societe Anonyme dite: Compagnie Generale d'Automatisme, Paris, France

[21] Appl. No.: 236,924

[22] Filed: Feb. 23, 1981

[30] Foreign Application Priority Data

Feb. 27, 1980 [FR] France ..... 80 04308

[51] Int. Cl.[3] ..... B07C 5/00

[52] U.S. Cl. ..... 209/706; 209/942; 209/652; 40/374; 360/132; 211/60 A; 221/88; 221/261

[58] Field of Search ..... 209/706, 942, 539, 653, 209/652, 654, 656, 916; 221/88, 261; 40/372, 374, 510, 513; 360/132; 211/50, 51, 53, 60 A, 495; 312/42, 50, 61

[56] References Cited

U.S. PATENT DOCUMENTS

| | | | |
|---|---|---|---|
| 1,119,531 | 12/1914 | Palmer | 209/942 X |
| 2,194,828 | 3/1940 | Greaves | 211/51 |
| 2,572,737 | 10/1951 | Lehner | 221/88 |
| 2,657,692 | 11/1953 | Dahl | 129/16 |
| 2,706,579 | 4/1955 | Kurtz | 211/51 X |
| 3,167,216 | 1/1965 | Harker et al. | 221/88 |
| 3,817,607 | 6/1974 | Anderson | 221/88 X |
| 4,192,425 | 3/1980 | Landau | 211/50 |

FOREIGN PATENT DOCUMENTS 2164479 8/1973 France .

*Primary Examiner*—Allen N. Knowles
*Attorney, Agent, or Firm*—Kenyon & Kenyon

[57] ABSTRACT

A guide unit (9) for the flat objects, the unit includes a plurality of guide paths (12,15,16) and movable along one side of a magazine for holding flexible flat objects transversely to the one side in locations spaced along the one side of the magazine, it being thus possible to place a first such guide path (12) opposite a first such location (6), the other guide paths of the guide unit, which diverge away from the first guide path being placed simultaneously opposite the locations (5,7) adjacent the first location.

An ejection device (10) moves any flat objects (8) contained in the neighbouring locations (5,7) outward from the one side of the magazine into the divergent paths (15,16) of the guide unit to provide a clear opening before an object is inserted in the first location.

3 Claims, 4 Drawing Figures

APPARATUS FOR INSERTING AND EXTRACTING FLEXIBLE FLAT OBJECTS INTO AND OUT FROM A MAGAZINE

The invention relates to apparatus in which flexible flat objects such as microfiches are stored in individual locations so that at any instant it is possible to extract one such object out from its location, or to insert one into an empty location.

BACKGROUND OF THE INVENTION

Microfiche storage magazines are often in the form of elongated rectangular boxes, with the microfiches accommodated therein parallel to the end surfaces. Two opposite side surfaces, e.g. the top surface and the bottom surface, out of the total of four side surfaces, are equipped with slide rails which engage the corresponding edges of microfiches. A third, at least partially open, side surface passes a mechanical unit such as a dog to push a microfiche to be extracted from the magazine out through the fourth side surface which is open.

The magazine is mounted to move parallel to its fourth surface relative to a microfiche extraction/insertion unit which includes a guide path. This makes it possible to choose the location from which the contents are to be extracted or, conversely, to choose an empty location in which a microfiche is to be inserted.

Such apparatus sometimes operates randomly and is therefore unsuitable to be incorporated in automatic equipment. Indeed, microfiches are usually produced on relatively flexible media and this prevents them from remaining absolutely plane. The result is that their mid portions bulge towards one or other of the adjacent locations. Such deformation is no hinderance when extracting since the dog can always be made to press against a portion of the end surface which is close to one of the guided edges. In contrast, such deformation can hinder and even prevent insertion of a microfiche in an unoccupied location adjacent to a location occupied by a microfiche that is bulging right into the unoccupied location.

Preferred embodiments of the present invention overcome this difficulty.

SUMMARY OF THE INVENTION

Broadly speaking this is achieved by providing means to partially extract any microfiches contained in the locations adjacent to an empty location and to make them diverge away from the empty location, thus clearing the way before insertion of a microfiche into said empty location.

More specifically the present invention provides apparatus for inserting and extracting flexible flat objects into and out from a magazine, said magazine being equipped with slide rails which determine the locations of said objects, wherein said apparatus comprises:

a guide unit for guiding said flat objects during extraction, said guide unit being movable relative to the magazine and having a plurality of guide paths including a first guide path capable of being situated in register with any selected location, and a plurality of other guide paths which are simultaneously situated in register with locations adjacent the selected location, said other guide paths diverging away from said first guide path;

means for partially extracting any of said objects from the selected location and from locations adjacent thereto such that said objects, if present, engage the corresponding guide paths, thereby causing the path-engaging leading ends of the objects in said adjacent locations to diverge away from said first guide path, and Means for fully extracting and alternatively at least partially inserting one of said objects via said first guide path.

In a preferred embodiment, said means for partially extracting any of said objects include a dog whose leading end presses against any object contained in said first location, and having shoulders set back from said leading end pressing against any objects contained in said adjacent locations such that an object in the selected location is pushed further out from the magazine than any objects in the adjacent locations.

BRIEF DESCRIPTION OF THE DRAWINGS

The invention will be better understood from the description of an embodiment of the invention given hereinafter with reference to the accompanying drawing in which.

DETAILED DESCRIPTION OF THE PREFERRED EMBODIMENT

Figure 1:
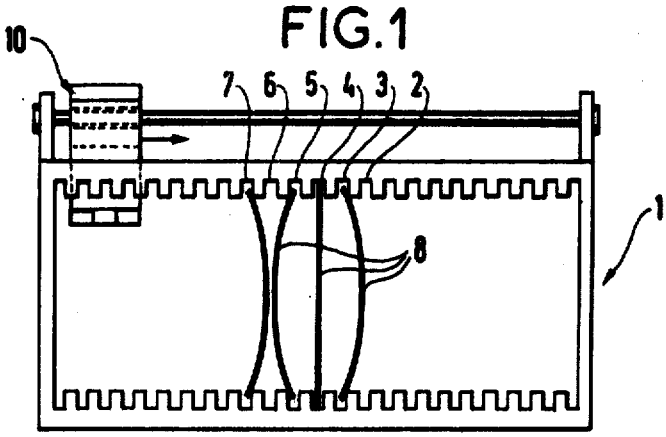
FIG. 1 is a front view of a magazine for storing flexible flat objects such as microfiches.

FIG. 1 therefore illustrates a magazine 1 with slide rails which determine locations such as 2,3,4,5,6,7.

Locations 3,4,5 and 7 are shown occupied by microfiches 8. Location 6 is empty. The microfiches are theoretically plane but in actual fact they assume various shapes. It may even happen that two non-adjacent microfiches bulge into an empty location to touch each other as illustrated at 5 and 7. Obviously, this greatly impedes the insertion of a microfiche into location 6 and, in the prior art, can make manual operation necessary.

Figure 2:
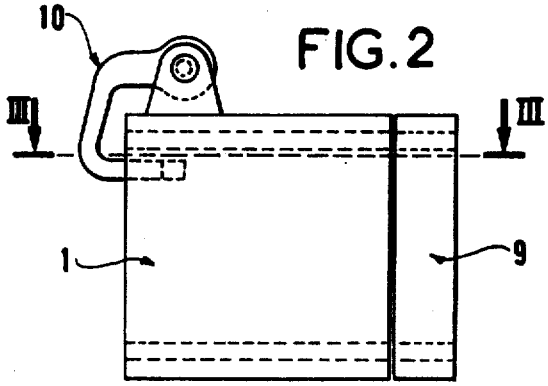
FIG. 2 is a left-hand view of a magazine illustrated in FIG. 1 and shows a guide unit in accordance with the invention.

FIG. 2 illustrates the left side of the magazine 1 of FIG. 1, showing the location of apparatus in accordance with the invention. Said apparatus includes more especially a microfiche guide unit 9 and a microfiche partial extraction unit 10.

Figure 3:
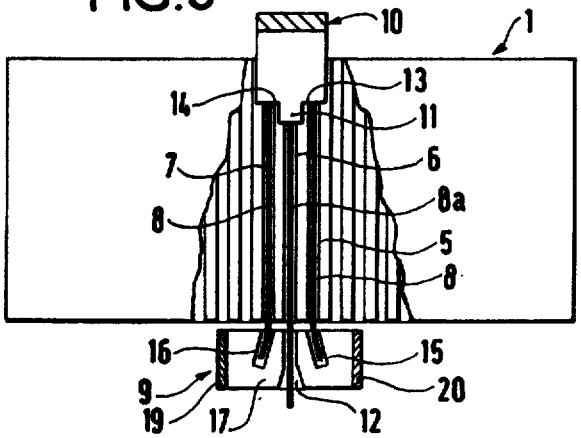
FIG. 3 is a top view of the magazine and guide unit, broken away in partial cross-section along III—III of FIG. 2.

FIG. 3 is a partial cross-section along III—III of FIG. 2 showing location 6 occupied by a microfiche **8*a* being extracted by the pushing action of a dog 11 belonging to unit 10. The microfiche follows a guide path 12 in unit 9. Unit 10 has a shoulder 13 on one side of its dog 11 and a shoulder 14 on the other side thereof. These shoulders push the adjacent microfiches 8 situated in locations 5 and 7 into diverging guide paths 15 and 16 located on either side of the guide path 12**.

Figure 4:
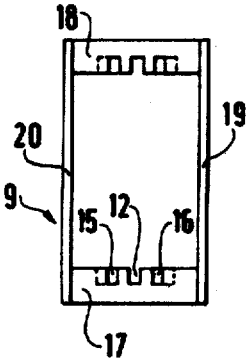
FIG. 4 is a front view from the magazine side of the guide unit shown schematically in FIGS. 2 and 3.

Guide paths 12, 15 and 16 may, for example, be formed by milling two plates such as 17 and 18 which are connected together by connecting members 19 and 20 as shown in FIG. 4, seen from the magazine side. It is obvious that these operations clear location 6 for subsequent insertion. It is also obvious that the operation is the same even if location 6 is originally empty since it is sufficient to carry it out prior to each insertion.

In extreme cases, microfiches separated by more than one empty location can be deformed to such an extent that it is necessary to correct the deformation not only of microfiches immediately adjacent to the location selected for insertion but also of microfiches further away therefrom. There must then be more than two divergent paths. However, experience to date suggests that, in practice, four divergent paths—two on each side of the insertion path are always sufficient.

Of course, once the operation is over and the microfiche such as 8*a* is inserted in its location, it is necessary to release the guide paths as a whole by pushing all the microfiches back fully home into their locations. An ordinary mechanical unit such as a bar, not illustrated, is sufficient for this purpose and the person skilled in the art will have no difficulty in producing one.

Likewise, once the path is cleared of neighbouring microfiches, the means which allow a microfiche such as 8*a* to be inserted in an empty space such as 6 can be made by the person skilled in the art and are not illustrated here. For example, such means may comprise a set of rollers or alternatively a movable plate provided with holes, the microfiches being held on the plate by suction.

It is practical for the end of the dog 11 to project forward from the shoulders 13 and 14 since this separates the microfiche 8*a* for extraction. However, it is not essential to do so and the microfiches 8 and 8*a* may be pushed out equally if the units for handling the microfiche 8*a* are capable of entering the inlet of the guide path 12 sufficiently.

Although the present invention has been described in relation to microfiches, it is also applicable to other flexible flat objects stored in magazines, for example cards and slides.

I claim:

1. Apparatus for inserting and removing flexible flat objects respectively into and from a storage magazine having at least one open side and a plurality of spaced parallel guide paths extending transversely with respect to the open side for engaging opposite edges of such flexible flat objects, the apparatus including a guide unit positioned adjacent to the open side of the magazine and having an insertion/extraction guide path selectively alignable with any guide path in the magazine and an ejection device positioned in transverse alignment with the guide unit on the side of the magazine opposite to the open side and having a contact surface movable in a plane parallel to the guide paths of the magazine for pushing a flat flexible object stored in the magazine in a selected guide path aligned with the insertion/ejection guide path in the guide unit outward from the open side of the magazine into engagement by the insertion/extraction guide path of the guide unit for subsequent extraction from the guide unit, wherein the improvement comprises:

said guide unit having at least one additional guide path located on each side of the insertion/extraction guide path, each additional guide path having an extrance aligned with a corresponding guide path in the magazine adjacent to the selected guide path and diverging away from the insertion/extraction guide path; and said ejection device having additional contact surfaces for pushing any objects stored in guide paths of the magazine adjacent to said selected guide path outward from the open side of the magazine into engagement by the corresponding diverging additional guide paths of the guide unit, whereby the objects pushed from said adjacent guide paths are bent away from the selected guide path to facilitate insertion of a flexible flat object into the selected guide path from the insertion/extraction guide path of the guide unit.

2. Apparatus according to claim 1 wherein the first-mentioned contact surface of said ejection device comprises a leading end of a dog, and the additional contact surfaces of the ejection device comprise shoulders set back from said leading end such that an object stored in the selected path is pushed further out from the magazine than any objects stored in the adjacent paths.

3. Apparatus according to claim 1 or 2 wherein said flexible flat objects are microfiches.

* * * * *